United States Patent [19]

Aaron

[11] Patent Number: 4,664,381

[45] Date of Patent: May 12, 1987

[54] GRIP FOR TENNIS RACKET

[75] Inventor: Alford Aaron, Lithonia, Ga.

[73] Assignee: Klink and Aaron Products, Ltd., Middletown, N.Y.

[21] Appl. No.: 766,555

[22] Filed: Aug. 19, 1985

[51] Int. Cl.[4] ..... A63B 49/08

[52] U.S. Cl. ..... 273/75; 273/29 A

[58] Field of Search ..... 273/75, 73 J, 81 B, 273/81.4, 81.5, 81.6, 29 R, 29 A, 165; 74/551.1, 551.8, 551.9; D21/221, 222; 434/247

[56] References Cited

U.S. PATENT DOCUMENTS

| | | | |
|---|---|---|---|
| 1,532,822 | 4/1925 | Kemp | 273/75 |
| 3,868,110 | 2/1975 | Jones | 273/75 |
| 3,905,598 | 9/1975 | Ballog | 273/75 |

FOREIGN PATENT DOCUMENTS

| | | | |
|---|---|---|---|
| 2928995 | 4/1981 | Fed. Rep. of Germany | 273/75 |

*Primary Examiner*—Richard C. Pinkham
*Assistant Examiner*—Matthew L. Schneider
*Attorney, Agent, or Firm*—James B. Middleton

[57] ABSTRACT

A grip for a tennis racket handle, the grip providing guides for proper gripping techniques and tending to discourage improper gripping techniques. A projection extends from the bottom of the handle to receive the forefinger both to place the forefinger and to provide a trigger for leverage in striking a ball. The side of the handle has a curved ridge, the rearward edge of which defines a thumb recess and the forward edge of which defines a trigger for a backhand grip. A knob rearwardly of the thumb recess defines the rear of the recess without obstructing other gripping techniques. A butt ridge provides a sufficient ridge to give the player a sure grip on the racket. The grip may be symmetrical, so the same grip can be used for both left-hand and right-hand gripping techniques.

6 Claims, 5 Drawing Figures

Fig. 1
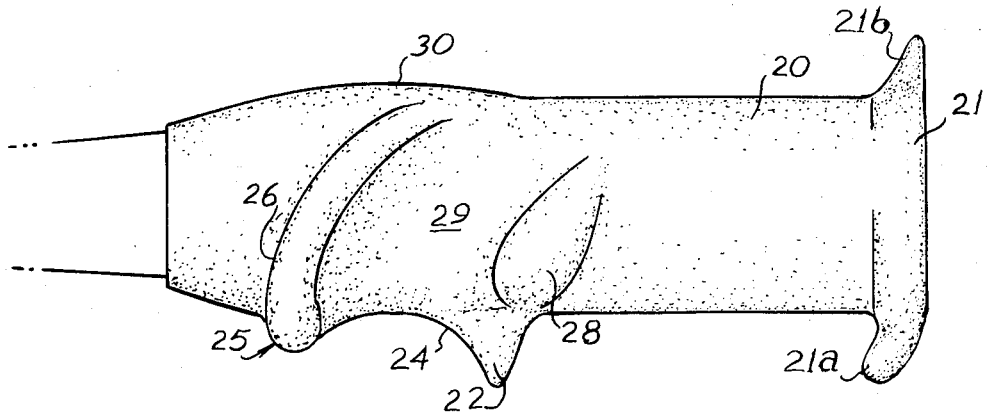
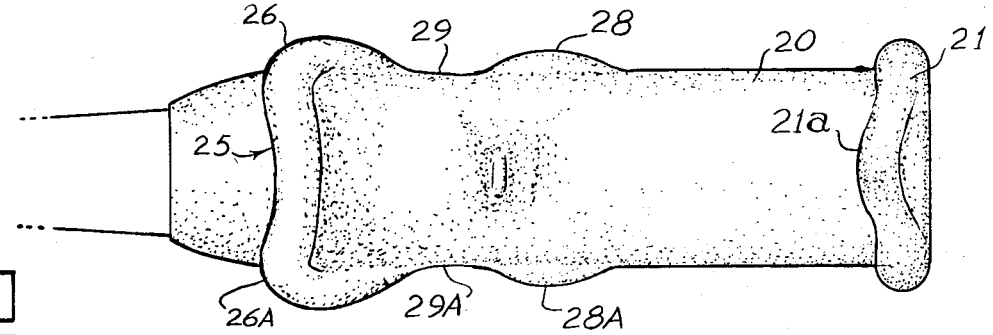
Fig. 2
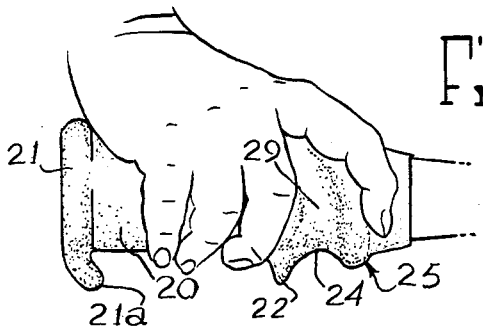
Fig. 3
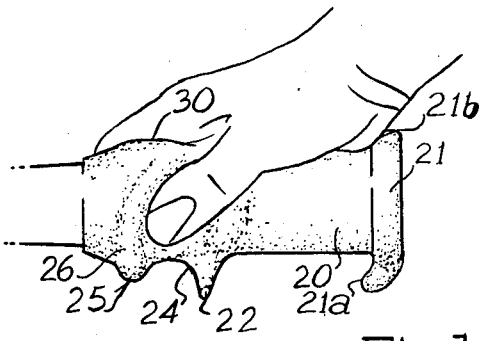
Fig. 4
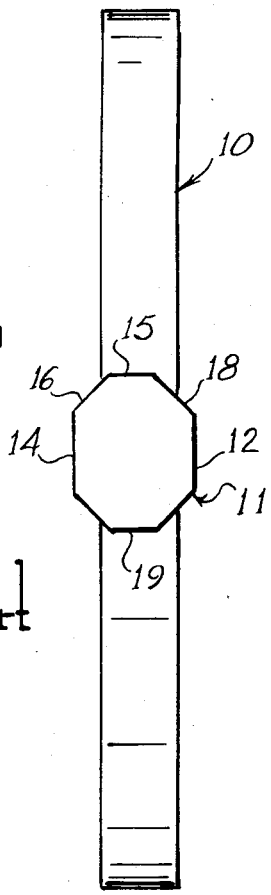
Fig. 5
Prior Art

GRIP FOR TENNIS RACKET

BACKGROUND OF THE INVENTION

In the game of tennis, as with many other sports, the way the racket is held is important both for general control of the racket and for application of appropriate power in striking the ball. In the game of tennis, there are several different ways to hold the racket, various techniques being preferred by various people.

In teaching the game of tennis, one must instruct the student in the proper gripping technique for the racket, and one instructor may teach more than one of the conventional techniques for gripping the racket. In attempting to describe a particular technique, the instructor must attempt to describe various portions of the hand, and make reference to portions of the racket handle. In both cases it is difficult to be completely specific, and a demonstration necessarily makes up a good portion of the instruction. While the demonstration is adequate during a lesson, the student may forget the demonstration when the student is practicing without the instructor, and the verbal communication may be the only recollection. At this point, the lack of specificity in the verbal instruction may cause errors in the student's practice.

There have been considerable efforts to develop a racket handle, or grip, that will at least indicate to the student how the racket is to be held, and preferably to require the racket to be held in a certain manner. Some of the prior art grips have apparently been developed by novice tennis players in that the technique for gripping the racket is incorrect in accordance with traditional standards. Other grips in the prior art may allow the correct positioning for one technique to hold a racket, but will not allow other, equally acceptable, gripping techniques.

SUMMARY OF THE INVENTION

This invention relates generally to racket handles, and is more particularly concerned with a grip for a racket, for tennis, racket ball and the like, that will act both as an instructional aid and as a playing aid, allowing the player to use any of the traditional gripping techniques.

The present invention provides a handle, or grip, for a racket having a principal gripping portion for receiving the hand of the player, a lower projection for receiving the forefinger in forehand grips and a forward ridge for receiving the forefinger in backhand grips. The forward ridge is duplicated on the opposite plate of the racket handle, and defines rearwardly thereof a thumb receiving guide, the thumb receiving guide being defined between the forward ridge and a smaller protuberance, or knob. The rearmost end of the racket includes a peripheral ridge for defining the end of the gripping portion, and for receiving the heel of the hand. The entire conformation of the racket handle is such that any of the standard gripping techniques can be utilized, the various protuberances and the like providing means for defining the gripping technique and for increasing power in a stroke with the racket.

BRIEF DESCRIPTION OF THE DRAWINGS

These and other features and advantages of the present invention will become apparent from consideration of the following specification when taken in conjunction with the accompanying drawings in which:

FIG. 1 is an elevational view of a racket handle made in accordance with the present invention;

FIG. 2 is a bottom plan view of the handle shown in FIG. 1;

FIG. 3 is a front elevational view of the racket handle shown in FIGS. 1 and 2, and illustrating a backhand gripping technique;

FIG. 4 is a rear elevational view of the handle and gripping technique shown in FIG. 3; and, FIG. 5 is a butt end view of a conventional tennis racket illustrating the conventional shape of the handle for reference purposes.

DETAILED DESCRIPTION OF THE EMBODIMENT

Referring now more particularly to the drawings, and to that embodiment of the invention here presented by way of illustration, attention is first directed to FIG. 5 of the drawings. The representation of the conventional tennis racket is to provide appropriate orientation for an understanding of the handle made in accordance with the present invention.

In FIG. 5, it will be seen that the head 10 of the racket is pointed away from the viewer, with the handle generally designated at 11 extending towards the viewer of the drawings. In this position, the large flat surface on the righthand side of the handle designated at 12 is referred to as the right plate, while the opposite surface designated at 14 is referred to as the left plate. The uppermost surface designated at 15 is referred to as the top plane, and the beveled portions 16 and 18 extending between the left plate and top plane and right plate and top plane are respectively referred to as the left bevel and the right bevel. Finally, the lower surface, parallel to the top plane, is referred to as the bottom plane 19.

In the following description, the orientation of the racket handle with respect to the racket head will be as just described, and the directions indicated will utilized even though the precise shape of the surfaces may be modified.

Looking now at FIG. 1 of the drawings, FIG. 1 presents the handle of a racket as one would view the left plate of the handle. It will be seen that there is a principal gripping portion indicated at 20. At the rearmost end, or butt, there is an enlarged ridge designated at 21, the butt ridge 21 extending completely around the butt of the racket handle. The butt ridge 21 is curved, or hooked, at **21*a* to receive the little finger for a secure grip, and is curved at 21*b*** to conform to the shape of the heel of the hand.

On the bottom edge of FIG. 1 as viewed in the drawings, there is a projection 22 which extends in a direction as from the bottom plane. Between the butt ridge 21 and the projection 22, the principal gripping area 20 is long enough to receive at least three fingers of an average person's hand comfortably. As will be discussed in more detail hereinafter, most of the gripping techniques will place the forefinger to the left of the projection 22. Thus, the finger recess 24 is curved for comfortably receiving the forefinger of the player.

Towards the head of the racket from the projection 22, and defining the left extremity of the finger receiving recess 24, there is a forward ridge generally designated at 25. This forward ridge 25 extends completely around the bottom plane of the handle, around the lower bevels, and merges into the body of the grip in the vicinity of the left and right bevels, adjacent to the top plane. The ridge 25 defines the forward surface of the finger receiving recess 24, then curves to its apex approximately at the bevels adjacent to the bottom plane. Following the apex 26, the ridge 25 curves rearwardly to terminate somewhat forwardly of the projection 22.

Substantially on the left plate, and approximately above the projection 22, there is a small projection, or knob, 28. Between the knob 28 and the ridge 25, there is a thumb recess 29. The knob 28 may also assist in defining the principal gripping area 20, and separating the gripping area 20 from the rest of the grip.

With attention now directed also to FIG. 2 of the drawings, it should first be understood that FIG. 2 is a view of the racket handle looking directly at the bottom plane of the handle. Thus, the projection 22 extends towards the viewer, and the knob 28 extends towards the top of the figure. It will now be seen that the proportions of the racket handle of the present invention are substantially the same as the proportions of the conventional racket handle as shown in FIG. 5. The view in FIG. 1 is approximately the width from top plane to bottom plane, and the view in FIG. 2 is approximately the thickness from the left plate to the right plate. FIG. 2 also shows that the handle made in accordance with the present invention is symmetrical, the side opposite the side shown in FIG. 1 being a mirror image thereof. Thus, there is a knob 28A on the bottom of FIG. 2, the knob 28A being substantially identical to the knob 28. Also, the ridge 25 extends forward to an apex 26A on the bottom of FIG. 2, and curves rearwardly to remain parallel to the ridge as shown in FIG. 1. There is then defined a thumb recess 29A between the ridge 25 and the knob 28A.

From the foregoing description, it should now be understandable that the racket handle of the present invention includes definite features as a guide to holding the racket handle, but all the features are sufficiently versatile that any of the conventional racket gripping techniques can be utilized. Even the "hammer grip" can be used by wrapping the hand around the principal gripping area 20, the butt ridge 21 lying adjacent to the heel of the hand to prevent the racket from slipping from the hand, while the projection 22 and the small mound 30 illustrated in FIG. 1 will provide sufficient definition above the hand.

To illustrate the feature of the invention whereby the portions of the handle can be used as guides, the following description will indicate the ease of explaining the various traditional grips.

To grasp the racket in the manner of the Eastern forehand grip, a player would grasp the handle of the racket, placing the crease of the forefinger at the first joint directly over the projection 22 in the finger receiving recess 24. With this simple placement, then wrapping the balance of the hand around the principal gripping area 20, one has attained the Eastern forehand grip. The heel of the hand will rest against the butt ridge 21, and the thumb will generally be placed just rearwardly of the knob 28. Thus, with the simple fact of how to place the forefinger with respect to the projection 22, the entire Eastern forehand grip can be repeated.

To attain the Semi-Western forehand grip the player will place the crease of the forefinger under the second knuckle over the projection 22. Again, with this single placement, then simply wrapping the balance of the hand around the principal gripping area 20, the thumb will naturally lie generally across the top plane of the handle below the mound 30 to achieve the Semi-Western Grip.

To attain the Western forehand grip, one will place the third joint of the forefinger over the projection 22, with the third joint received within the finger receiving recess 24. Then, simply wrapping the hand around the principal gripping area 20, the thumb will lie across the right bevel and top plane and the player is automatically in the Western forehand grip.

The Continental grip is used for both forehand and backhand without changing, and this grip is attained by placing the first joint of the forefinger in the finger receiving recess 24 on the projection 22. The hand is then wrapped around the handle with the heel of the hand substantially against the butt ridge 21, and the thumb extending across the left plate on the butt side of the knob 28. Again, with one placement remembered, the grip can be repeated.

The Eastern backhand grip is illustrated in FIGS. 3 and 4 of the drawings, since this grip well illustrates the use of several of the features of the present invention. To attain the Eastern backhand grip, the player will place the base knuckle of the forefinger over the right half of the top plane 15. The forefinger is then extended along the forward surface of the forward ridge 25A. Once this forefinger is in place, the hand is simply wrapped around the principal gripping portion 20 and one has achieved the Eastern Backhand grip. FIG. 3 illustrates the position of the forefinger above the ridge 25A, with the remaining three fingers of the hand wrapped around the principal gripping portion 20, and the heel of the hand generally against the butt ridge 21.

FIG. 4 illustrates the opposite size of the handle with the same grip, and it will be seen that the thumb is in the thumb receiving recess 29. Though some players prefer this position, other players will move the thumb towards the butt of the racket to lie on the butt side of the knob 28. It will be seen that the handle of the present invention allows either of these positions, and either position is considered correct.

It is important to note that a gripping technique that is considered bad in tennis is to place the thumb generally parallel to the centerline of the racket handle. Using the grip of the present invention, it will be noted that the ridge 25 makes such placement difficult; rather, one would tend to rest the thumb in the recess 29, giving correct placement. Also, it is considered to be important to keep the forefinger forward, towards the racket head, from the thumb when using a backhand grip. As is well illustrated in FIGS. 3 and 4, the grip made in accordance with the present invention renders this technique quite natural, and tends to discourage the incorrect gripping technique.

It will therefore be seen that the racket handle made in accordance with the present invention provides a very simple construction that allows great versatility in use of a racket. While any of the acceptable gripping techniques can be utilized with the grip of the present invention, the grip is so constructed as to discourage improper gripping techniques, and to simplify the obtaining of the various accepted gripping techniques. Furthermore, the projection 22 and the ridge 25 are in the nature of triggers to provide an excellent grasp on the racket and good leverage when striking the ball. The projection 22 is of course utilized with the various forehand grips discussed, and the ridge 25 is utilized in the background grip as illustrated in FIG. 3.

From the foregoing discussion, it will be realized that the butt ridge 21 defines one end of the principal gripping surface 20 and the knob 28 and other features are forward of the principal gripping surface 20. It will therefore be obvious to those skilled in the art that the principal gripping surface 20 may be in the form of the conventional racket handle as illustrated in FIG. 5, and only the forward and rear portions of the handle may be modified to provide the features of the present invention. Also, it will be understood that the racket handle of the present invention may be made as a permanent part of a tennis racket, or it may be a removable grip to be slipped over the conventional racket handle, and it may be made in two pieces for variation of the length of the portion 20.

It will therefore be understood that the embodiment of the invention here presented is by way of illustration only, and is meant to be in no way restrictive; therefore, numerous changes and modifications may be made, and the full use of equivalents resorted to, without departing from the spirit or the scope of the invention as defined in the appended claims.

What is claimed is:

1. A grip for a tennis racket, said racket having a head at one end thereof and a handle at the opposite end thereof, said head being at the forward end of the racket and said handle being at the rear end of the racket, the rearmost end of said handle being the butt of said handle, said handle having a top plane defined on the upper surface of the handle when the tennis racket is held generally horizontally in normal playing position, a bottom plane on the lower surface of the handle generally parallel to said top plane, a right plate and a left plate perpendicular to said top and bottom planes, and right and left bevels extending from said right and left plates respectively to said top plane, said grip including a butt ridge extending around said handle at the butt end thereof, a generally unobstructed principal gripping area defined forwardly of said butt ridge and being sufficiently long to receive a portion of a player's hand with at least three fingers of the hand around said principal gripping area, a projection extending from said bottom plane at the forward end of said principal gripping area, a forward ridge extending around said handle, said forward ridge lying across said bottom plane at a location spaced forwardly from said projection and defining a finger receiving recess for selectively receiving the forefinger of a player between said projection and said forward ridge on said bottom plane, said forward ridge further curving forward from said bottom plane toward said right and left plates to an apex between said bottom plane and said plates, then curving rearwardly towards said right and left bevels and terminating adjacent to said bevels and slightly forward of said projection, said forward ridge being so located along said plates selectively to receive the forefinger of a player's hand while three fingers are received on said principal gripping area, said forward ridge being so shaped and so located as to define the forward limit for the player's hand with said grip in a plurality of rotational positions with respect to the player's hand, said grip further including a thumb receiving recess defined on said plates to the rear of said forward ridge.

2. A grip as claimed in claim 1, and further including knobs extending from said plates rearwardly of said thumb receiving recess, each said knob defining the rear side of said thumb receiving recess, the combination of said knobs and said forward ridge being such as to discourage the player from placing the thumb linearly of said grip with the thumb crossing said knob and said forward ridge.

3. A grip as claimed in claim 2, and further including a mound defined on said top plate for defining the forward end of said principal gripping area.

4. A grip as claimed in claim 3, said projection being long enough to receive the forefinger of a player, and including the third joint of said forefinger.

5. A grip as claimed in claim 4, each said knob comprising a slight rise from said plate, and being slight enough to allow the player's thumb to be received on the rearward edge of said knob.

6. A grip as claimed in claim 5, said principal gripping area having substantially the dimensions of a conventional tennis racket handle.

* * * * *